US006666654B2

(12) United States Patent
Olhofer et al.

(10) Patent No.: US 6,666,654 B2
(45) Date of Patent: Dec. 23, 2003

(54) TURBINE BLADE AIRFOIL AND TURBINE BLADE FOR AXIAL-FLOW TURBINE

(75) Inventors: Markus Olhofer, Seligenstadt (DE); Bernhard Sendhoff, Obertshausen (DE); Satoshi Kawarada, Saitama (JP); Toyotaka Sonoda, Saitama (JP); Toshiyuki Arima, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/087,986

(22) Filed: Mar. 5, 2002

(65) Prior Publication Data

US 2003/0170125 A1 Sep. 11, 2003

(51) Int. Cl.[7] ..... F01D 5/14
(52) U.S. Cl. ..... 416/228; 416/237; 416/223 A
(58) Field of Search ..... 415/191, 208.2, 415/211.2, 181, 914; 416/223 R, 243, 96 R, 97 R, 223 A, 237, 228

(56) References Cited

U.S. PATENT DOCUMENTS 4,240,598 A * 12/1980 Vinas Espin et al. ..... 244/35 R
5,318,406 A * 6/1994 Bardes ..... 416/223 A
6,179,565 B1 * 1/2001 Palumbo et al. ..... 416/97 R

FOREIGN PATENT DOCUMENTS

| | | |
|---|---|---|
| JP | 57-113906 | 7/1982 |
| JP | 7-332007 | 12/1995 |
| JP | 9-125904 | 5/1997 |

* cited by examiner

*Primary Examiner*—Ninh H. Nguyen
(74) *Attorney, Agent, or Firm*—Arent Fox Kintner Plotkin & Kahn PLLC

(57) ABSTRACT

A blade for an axial-flow turbine includes an intrados producing a positive pressure between a leading edge and a trailing edge, and an extrados producing a negative pressure. The intrados is formed at its rear portion with a flat surface portion connected to the trailing edge, and the extrados has a curved surface portion formed at least at a portion corresponding to the flat surface portion. The trailing edge of the turbine blade is pointed at its end. The angle of intersection between the intrados and the extrados at the trailing edge is a right angle or an acute angle. Thus, it is possible to inhibit the flowing of a gas from the intrados at the trailing edge toward the extrados and to decrease the degree of curvature of the extrados at the trailing edge portion to reduce the flow speed, thereby minimizing a shock wave generated at the trailing edge portion to reduce the pressure loss and enhance the performance of the turbine.

5 Claims, 8 Drawing Sheets

PRESENT INVENTION

TURBINE BLADE AIRFOIL AND TURBINE BLADE FOR AXIAL-FLOW TURBINE

BACKGROUND OF THE INVENTION

1. Field of the Invention

The present invention relates to a turbine blade airfoil for an axial-flow turbine, including an intrados producing a positive pressure between a leading edge and a trailing edge, and an extrados producing a negative pressure, as well as to a turbine blade to which such turbine blade airfoil is applied.

2. Description of the Related Art

A common shape of a trailing edge portion in a conventional turbine blade S for an axial-flow turbine is shown in FIG. 8. More specifically, the trailing edge portion of the turbine blade S shown as being encircled in FIG. 8 includes an arcuate surface St having a trailing edge radius r, an extrados Su extending from an upper end of the arcuate surface St toward a leading edge LE and mainly producing a negative pressure during operation of the turbine, and an intrados S1 extending from a lower end of the arcuate surface St toward the leading edge LE and mainly producing a positive pressure during operation of the turbine. A trailing edge TE of the turbine blade S is defined as a point of intersection between the arcuate surface St and a camber line CL. Therefore, the trailing edge TE of the conventional turbine blade S is not pointed at its end but defined as a point on the arcuate surface St having the trailing edge radius r.

There are conventionally known inventions relating to the shape of a trailing edge portion of a turbine blade, which are described in Japanese Patent Application Laid-open Nos. 57-113906, 7-332007 and 9-125904.

The turbine blade described in Japanese Patent Application Laid-open No. 57-113906 has an arrangement in which the trailing edge portion is curved toward the side of the extrados, or an arrangement in which the curvature of the extrados at the trailing edge portion is larger than that of the intrados. This arrangement ensures that the generation of a shock wave at a transonic speed is controlled to provide an alleviation in load applied to the turbine blade and a reduction in pressure loss.

In the turbine blade described in Japanese Patent Application Laid-open No. 7-332007, a corrugated unevenness is formed at the trailing edge portion. This arrangement ensures that the distribution of flow in a radial direction of the turbine is liable to be interfered, and the proportion of speed loss provided by a wake is decreased, thereby providing an enhancement in performance of flow at each stage of the turbine.

In the turbine blade of the vapor turbine described in Japanese Patent Application Laid-open No. 9-125904, the extrados is notched at a tailing edge portion rectilinearly. This arrangement ensures that a reduction in pressure loss is provided, while ensuring a resistance to erosion due to vibration provided by a vapor flow or due to foreign matters within a vapor flow.

The conventionally known turbine blade S of the axial-flow turbine shown in FIG. 8 exhibits a satisfactory performance in a state in which the flow speed along a blade surface is a high subsonic speed and no shock wave is generated. However, the conventionally known turbine blade S suffers from a problem that if the flow speed at the trailing edge portion reaches a sonic speed, shock waves SW1 and SWu generated from the intrados S1 and the extrados Su at the trailing edge portion cause a reduction in performance. More specifically, the shock wave SW1 generated from the intrados S1 at the trailing edge portion interferes with a boundary layer on the side of the extrados Su of an adjacent turbine blade S to cause the generation of a pressure loss. The shock wave SWu generated from the extrados Su at the trailing edge portion provides a strain or a deformation to a blade cascade of the turbine at a downstream stage to make an enhancement in performance of the entire turbine difficult.

SUMMARY OF THE INVENTION

The present invention has been accomplished with the above circumstance in view, and it is an object of the present invention to suppress the shock waves generated from the trailing edge portion of the turbine blade of the axial-flow turbine to the minimum to enhance the performance of the turbine.

To achieve the above object, according to a first feature of the present invention, there is provided a turbine blade airfoil for an axial-flow turbine, comprising an intrados producing a positive pressure between a leading edge and a trailing edge, and an extrados producing a negative pressure, wherein the trailing edge is pointed at its end; the intrados is provided at its rear portion with a flat surface portion connected to the trailing edge; and the extrados has a curved surface portion provided at least at a portion thereof corresponding to the flat surface portion.

With the above arrangement, the trailing edge of the turbine airfoil is pointed at its end; the intrados is provided at its rear portion with the flat surface portion connected to the trailing edge; and the extrados has the curved surface portion provided at least at its portion corresponding to the flat surface portion. Therefore, the flowing of a gas from the intrados toward the extrados at the trailing edge portion can be inhibited to moderate a shock wave generated on the intrados at the trailing edge portion, thereby suppressing the pressure loss to the minimum.

According to a second feature of the present invention, in addition to the arrangement of the first feature, there is provided a turbine blade airfoil for an axial-flow turbine, wherein the angle $\alpha$ of intersection between the intrados and the extrados at the trailing edge is a right angle or an acute angle.

With the above arrangement, the angle $\alpha$ of intersection between the intrados and the extrados at the trailing edge is a right angle or an acute angle and therefore, the degree of curvature of the extrados at the trailing edge portion can be decreased to reduce the flow speed, and a shock wave generated on the extrados can be moderated, thereby further decreasing the pressure loss.

According to a third feature of the present invention, there is provided a turbine blade for an axial-flow turbine, which turbine blade is obtained by applying the turbine blade airfoil according to the first or second feature to at least a portion of the turbine blade in a span direction.

With the above arrangement, the turbine blade airfoil according to the present invention and a conventional turbine blade airfoil can be utilized in combination with each other, thereby increasing the degree of freedom in the design of the turbine blade.

The above and other objects, features and advantages of the invention will become apparent from the following description of the preferred embodiment taken in conjunction with the accompanying drawings.

DESCRIPTION OF THE PREFERRED EMBODIMENTS

The mode for carrying out the present invention will now be described by way of embodiments of the present invention shown in the accompanying drawings.

FIGS. 1 to 5 show a first embodiment of the present invention.

Figure 1:
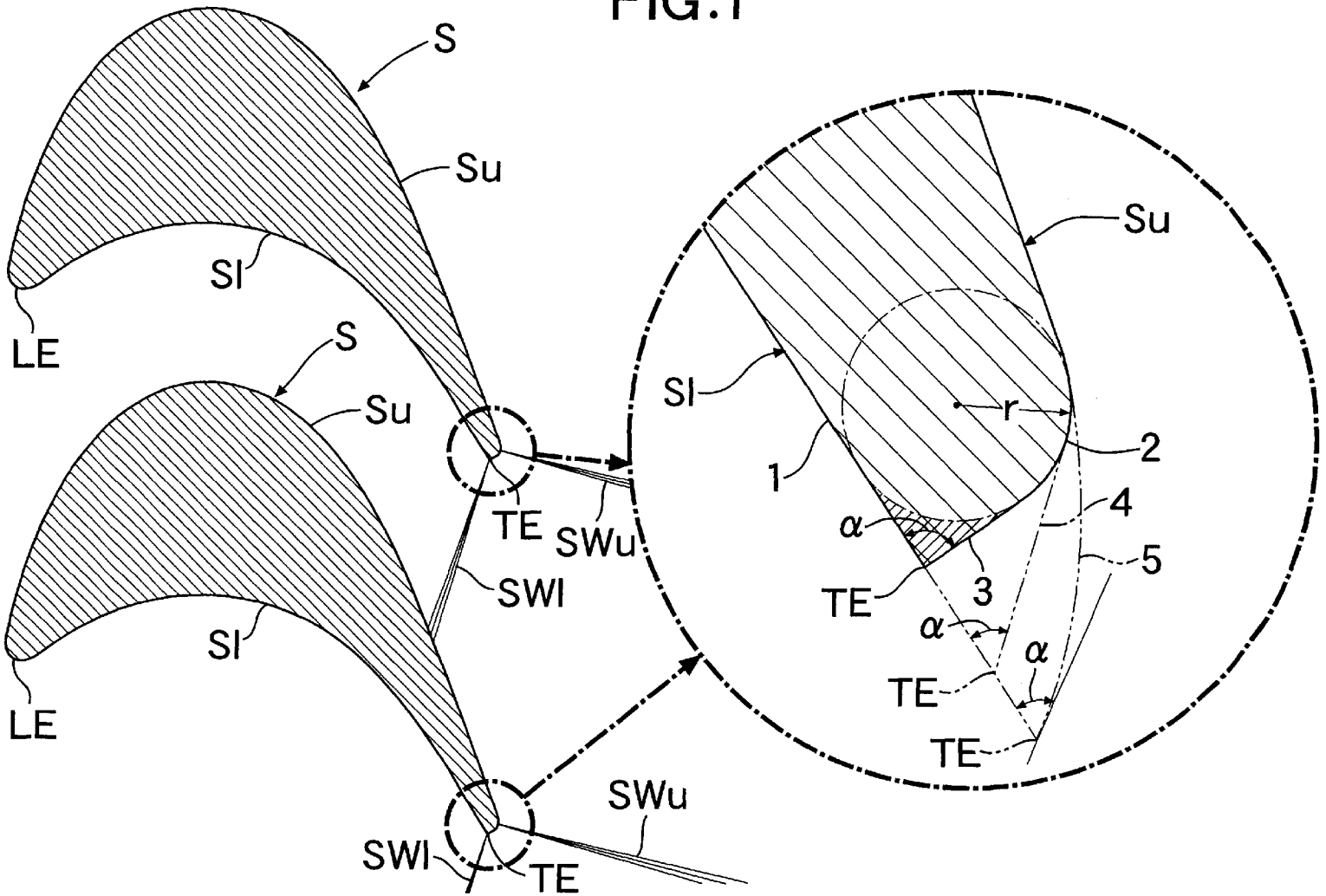
FIG. 1 is an enlarged diagram of a turbine blade airfoil and a trailing edge portion for an axial-flow turbine.
Figure 8:
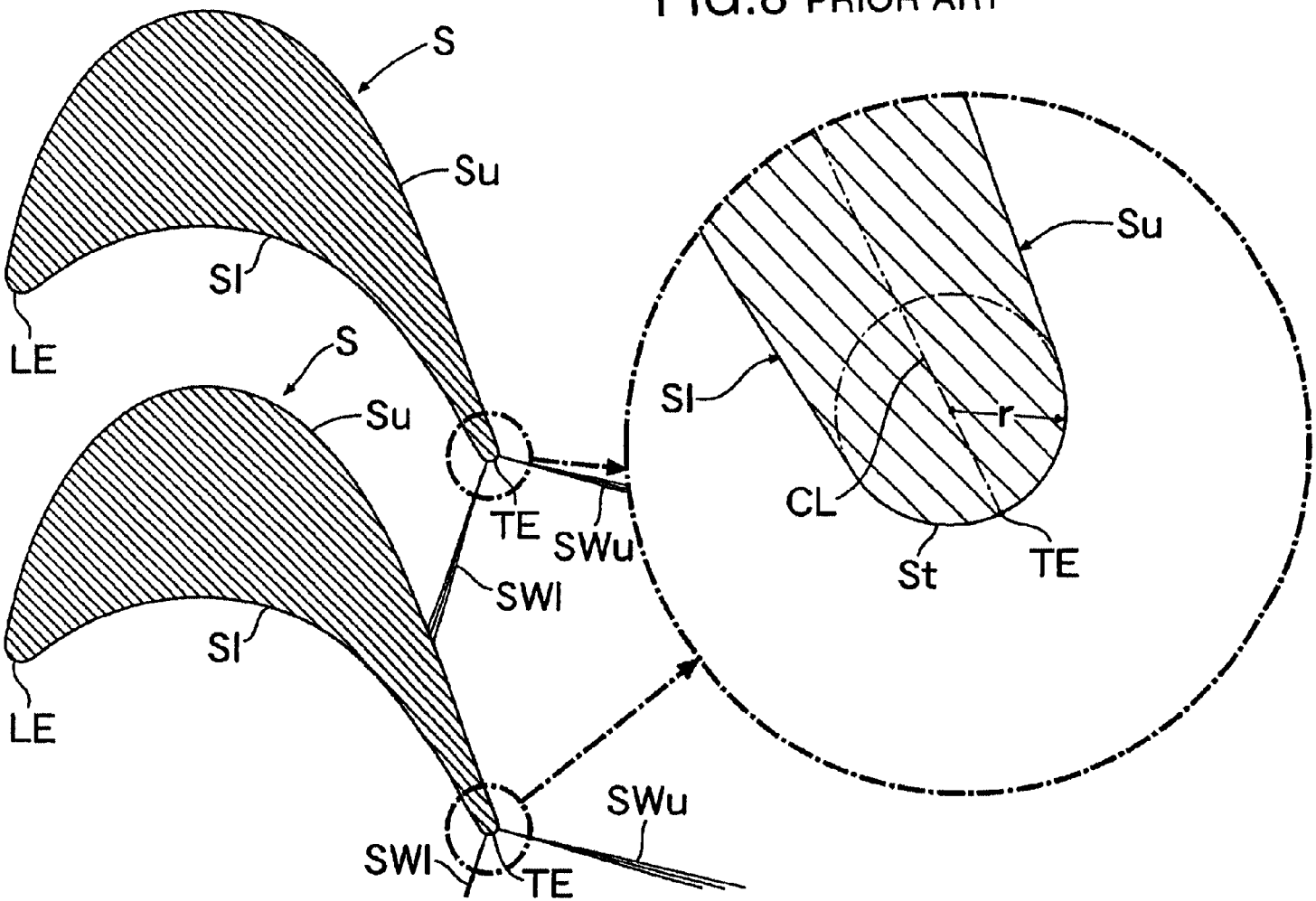
FIG.8 PRIOR ART
FIG. 8 is an enlarged diagram of a turbine blade airfoil and a trailing edge portion for a conventionally known axial-flow turbine.

Turbine blades S shown in FIG. 1 are disposed in an annular gas passage in an axial-flow turbine to form a turbine blade cascade. The turbine blade S includes an intrados S1 (a positive pressure surface) producing a positive pressure with flowing of a gas, and an extrados Su (a negative pressure surface) producing a negative pressure with the gas flow. The intrados S1 and extrados Su are provided between a leading edge LE at a left end and a trailing edge TE at a right end. A flat surface portion 1 is formed on the intrados S1 at the trailing edge of the turbine blade S, and the trailing edge pointed sharply is formed at a rear end of the flat surface portion 1, as shown in an enlarged manner within a circle in FIG. 1. On the other hand, at a trailing edge portion of the turbine blade S, the extrados Su is connected to the trailing edge TE through a curved surface portion 2 and a flat surface portion 3. The curved surface portion 2 comprises a portion of a circle having a radius r and inscribed with the trailing edge portion, and the flat surface portion 3 circumscribed with the curved surface portion 2. An angle $\alpha$ of intersection formed the straight portion 1 of the intrados S1 and the straight portion 3 of the extrados Su is set a right angle. The curved surface portion 2 of the extrados Su is disposed such that it is accommodated in a relatively narrow region, namely, in a range of the flat surface portion 1 of the intrados S1. Therefore, the trailing edge portion of the turbine blade S according to the embodiment shown in FIG. 1 corresponds to a trailing edge portion (see FIG. 8) of the conventional turbine blade S, to which an obliquely lined portion is added.

Figure 4:
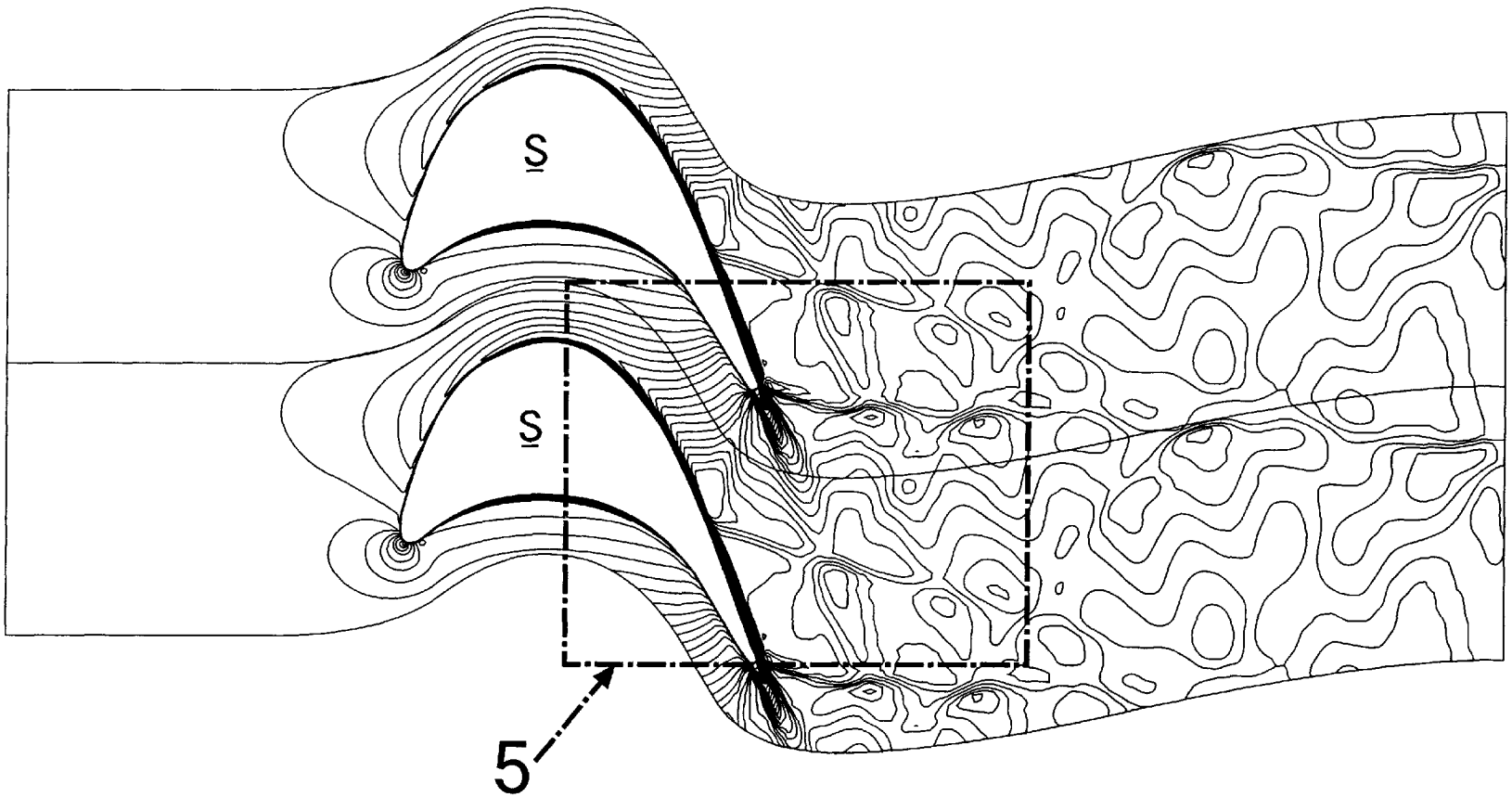
FIG. 4 is a diagram showing the behavior of a flow about a turbine blade in a visualized manner.
Figure 5:
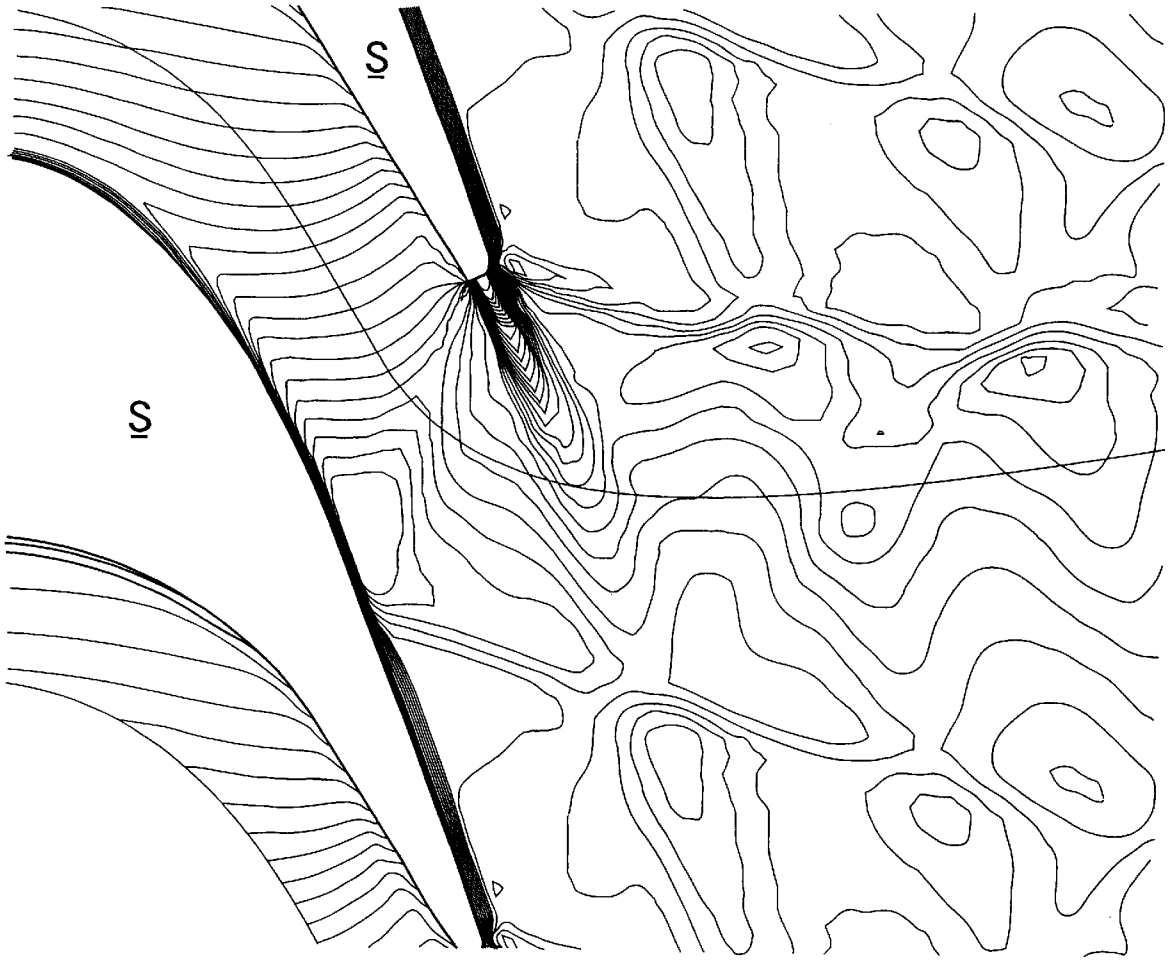
FIG. 5 is an enlarged diagram of a portion indicated by 5 in FIG. 4.
Figure 6:
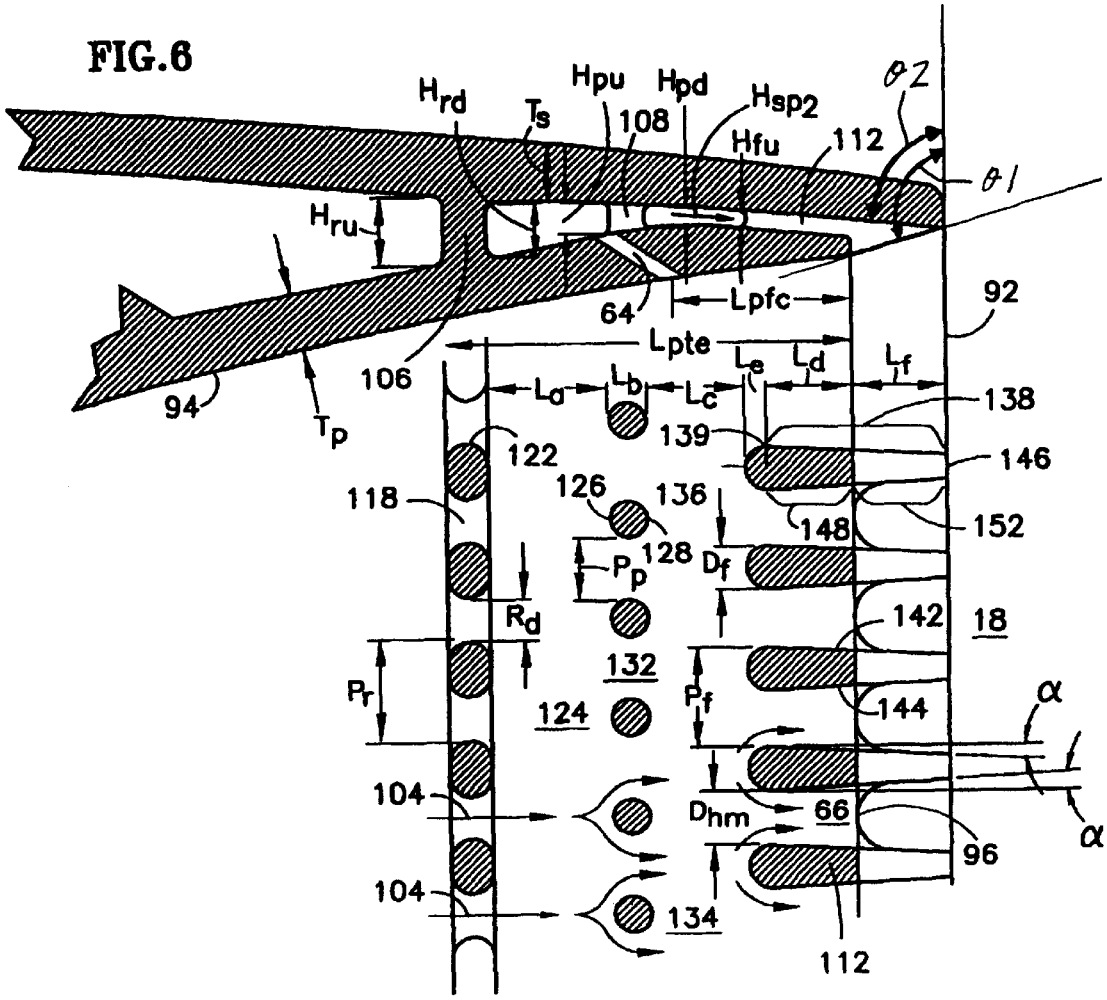
FIG. 6 is a diagram showing the behavior of a flow about a conventionally known turbine blade in a visualized manner.
Figure 7:
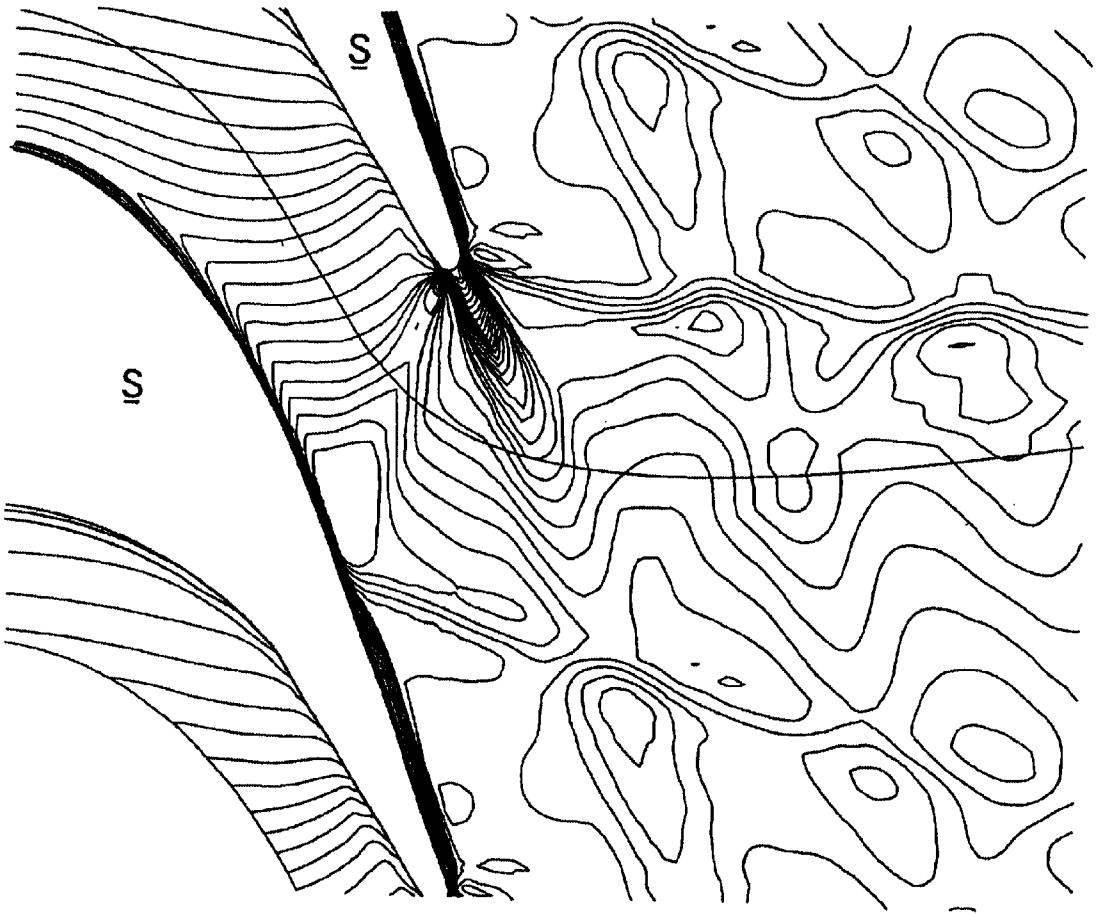
FIG.7 PRIOR ART
FIG. 7 is an enlarged diagram of a portion indicated by 7 in FIG. 6.

From the forgoing, when the flow speed of a gas reaches a supersonic speed at the trailing edge portion of the turbine blade S during operation of the axial-flow turbine, a shock wave SW1 extending obliquely rearwards and downwards from the trailing edge portion and a shock wave SWu extending obliquely rearwards and upwards are generated. The states of the shock waves SW1 and SWu generated at the trailing edge portion of the turbine blade S according to the present embodiment are shown in FIGS. 4 and 5. The states of shock waves SW1 and SWu generated at a trailing edge portion of the conventional turbine blade S (see FIG. 8) are shown in FIGS. 6 and 7.

The shock wave SW1 extending obliquely rearwards and downwards from the trailing edge portion may collide against the extrados Su of the turbine blade S adjoining the intrados S1, whereby a boundary layer formed along the extrados Su and the shock wave SW1 may interfere with each other to produce a pressure loss. However, it is possible to inhibit the flowing of the gas from the intrados S1 through the trailing edge TE toward the extrados Su to moderate the generation of the shock wave SW1 extending obliquely rearwards and downwards, thereby suppressing the pressure loss to the minimum, because, the flat surface portion 1 connected to the trailing edge TE is formed at the rear portion of the intrados S1 of the turbine blade S, and the trailing edge TE is formed into a pointed shape having an extremely small radius of curvature in the present embodiment.

Even on the extrados Su of the turbine blade S, the flow speed of the gas is reduced to moderate the generation of the shock wave SWu extending obliquely rearwards and upwards. As a result, it is possible to prevent a strain and a deformation from being produced in a turbine blade cascade at the subsequent stage by the shock wave SWu, leading to an enhancement in performance of the entire turbine.

Figure 2:
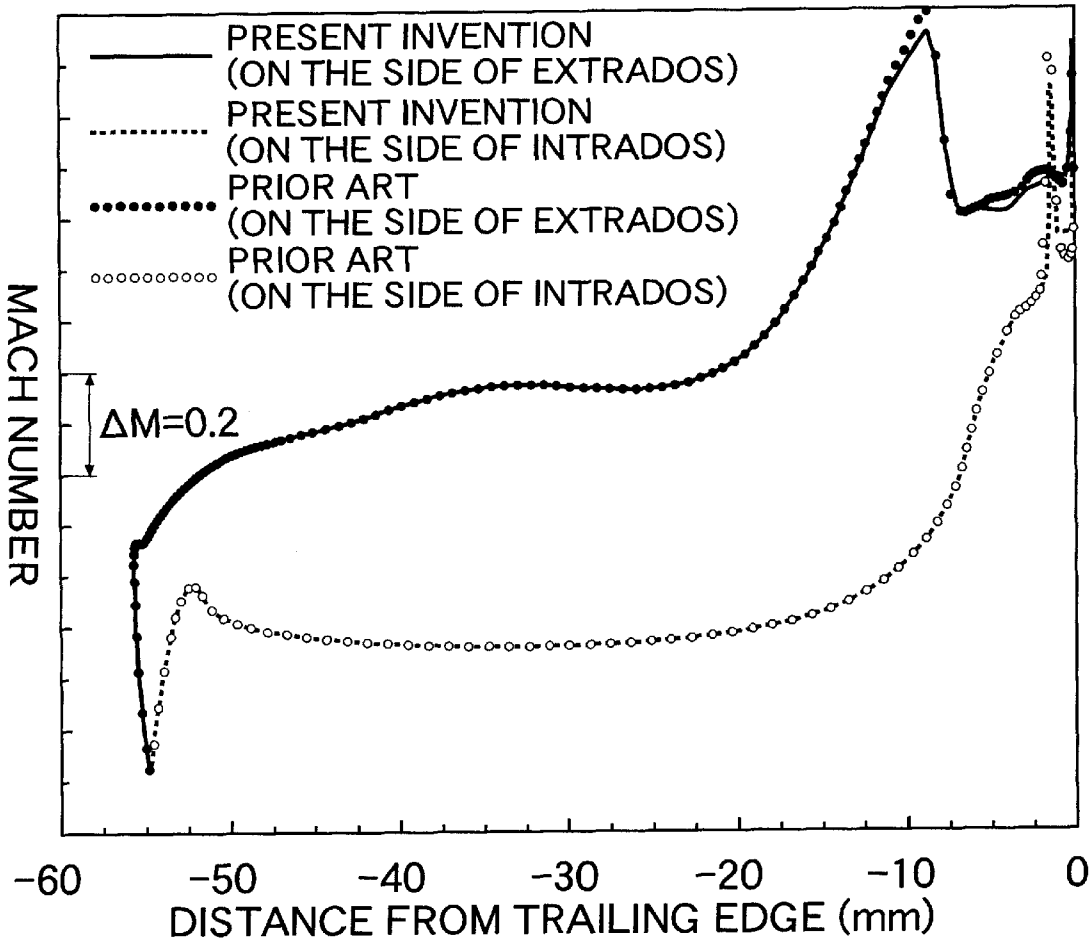
FIG. 2 is a graph showing the distributions of flow speed along an intrados and an extrados extending along a blade chord.

The distributions of flow speed along the intrados and the extrados extending along a blade chord are shown in FIG.2. As can be seen by comparison of the conventional turbine blade S and the turbine blade according to the present embodiment, it is presumed that a peak of flow speed at a location extremely near the trailing edge TE in the present embodiment is decreased, and the shock wave SW1 extending obliquely rearwards and downwards from the trailing edge portion is moderated, as compared with that in the conventional turbine blade. On the extrados Su of the turbine blade S, it is presumed that a peak of flow speed at a location slightly ahead of the trailing edge TE is reduced, and the shock wave SWu extending obliquely rearwards and upwards from the trailing edge portion is moderated, as compared with that in the conventional turbine blade.

Figure 3:
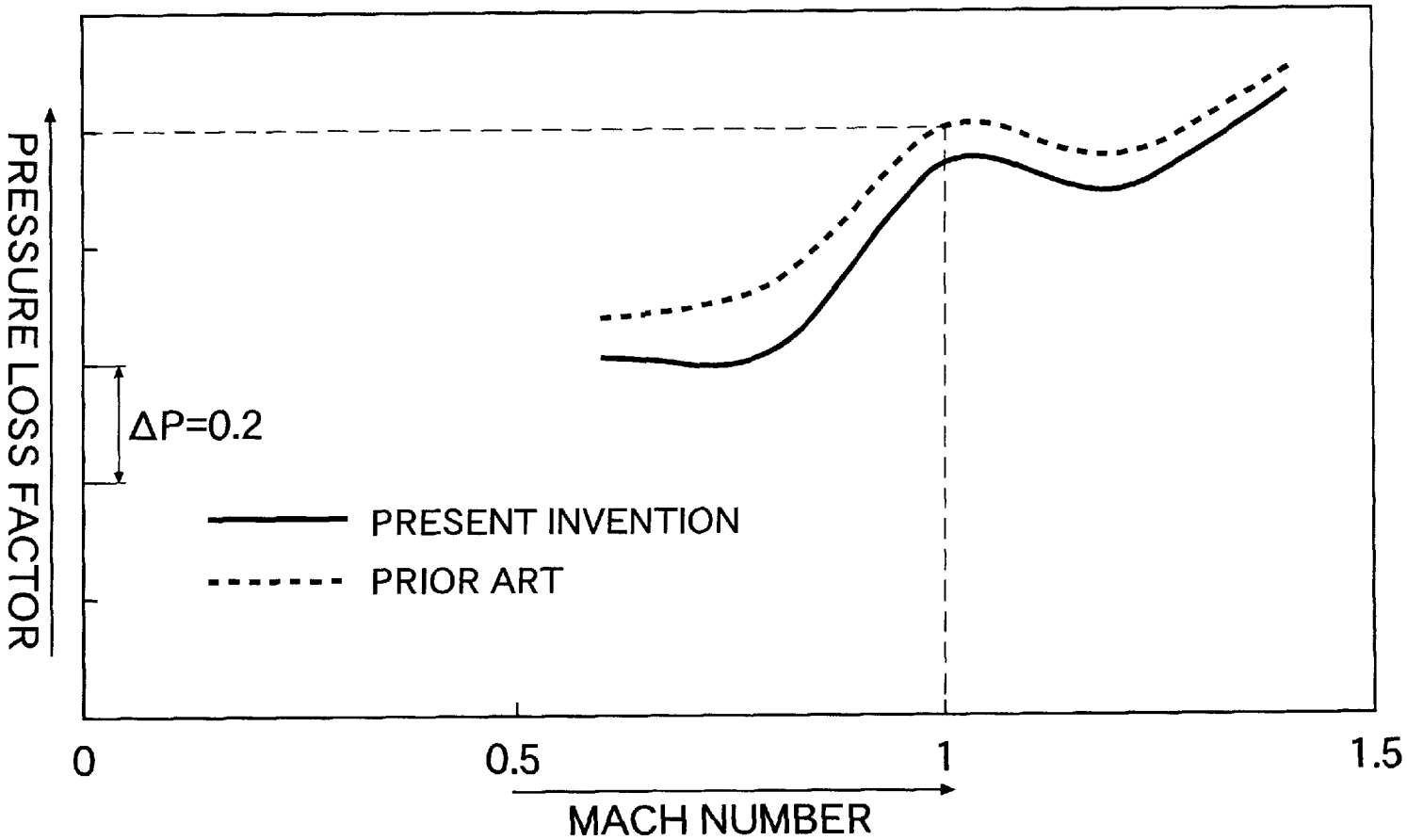
FIG. 3 is a graph showing variations in pressure loss with respect to the mach number.

A pressure loss varied depending on the mach number is shown in FIG. 3. As can be seen by comparison of the conventional turbine blade S with the turbine blade according to the present embodiment, if the pressure loss in the conventional turbine blade Sat a mach number of 1.0 is defined to be 1.0, the pressure loss in the turbine blade according to the present embodiment at a mach number of 1.0 is confined to 0.935 and reduced by 6.5%. Such a pressure loss reducing effect is achieved substantially likewise in a wide range of mach number of 0.6 to 1.4.

The shape of the trailing portion of the turbine blade S according to the present invention may be changed in the following manner: In the shape of the trailing portion of the turbine blade S according to the first embodiment, the angle $\alpha$ of intersection between the flat surface portion 1 of the intrados S1 and the flat surface portion 3 of the extrados Su at a trailing edge TE is set at a right angle. Alternatively, the angle $\alpha$ of intersection between the flat surface portion 1 of the intrados S1 and a flat surface portion 4 of the extrados Su may be set at an acute angle (in a second embodiment). Yet alternatively, in place of the combination of the curved surface portion 2 and the flat surface portion 4 of the extrados Su (in the second embodiment), a curved surface portion 5 comprising an arcuate surface tangent to the curved surface portion 2 may be formed, so that a rear end of the curved surface portion 5 may be disposed to intersect a rear end of the flat surface portion 1 of the intrados S1 at the trailing edge TE (in a third embodiment). In this case, the intersection angle $\alpha$ is defined as an angle formed by the flat surface portion 1 and a line extending through the trailing edge TE tangentially to a curved surface portion 5. This intersection angle $\alpha$ is an acute angle.

According to the second embodiment, the length of the curved surface portion 2 is shorter than the length of the curved surface portion 2 in the first embodiment, and according to the third embodiment, the radius of curvature of the curved surface portion 5 is larger than that of the curved surface portion 2 in the first embodiment. Therefore, it is possible to inhibit an increase in flow speed at the rear portion of the extrados Su of the turbine blade S and to further effectively inhibit the shock wave SWu extending obliquely rearwards and upwards from the trailing edge portion. Thus, according to the second and third embodiments, an effect of reducing the pressure loss by about 10% which is more than that in the first embodiment can be expected.

Although the embodiments of the present invention have been described in detail, it will be understood that the present invention is not limited to the above-described embodiments, and various modifications in design may be made without departing from the subject matter of the invention.

For example, each of the curved surface portion 2 in each of the first and second embodiments and the curved surface portion 5 in the third embodiment is formed as the arcuate surface, but is not necessarily the arcuate surface. The position of the curved surface portion 2, 5 in the direction of the chord is not limited to that in the embodiments, and the curved surface portion may be formed at least at a portion of the extrados Su corresponding to the flat surface portion 1 of the intrados S1.

The turbine blade S according to the present invention can be applied to any of a stator blade and a rotor blade.

The turbine blade airfoil according to the present invention may be employed over the entire region or only in a partial region of the turbine blade S in a span direction. In other words, the turbine blade airfoil according to the present invention (e.g., the blade airfoil shown in FIG. 1) may be employed in a portion of the turbine blade S in the span direction, and a turbine blade airfoil other than according to the present invention may be employed in the remaining portion. Thus, the turbine blade airfoil according to the present invention and the conventional turbine blade airfoil can be used properly in combination, thereby increasing the degree of freedom in the design of the turbine blade.

What is claimed is:

1. A turbine blade airfoil for an axial-flow turbine, comprising an intrados producing a positive pressure between a leading edge and a trailing edge, and an extrados producing a negative pressure, wherein said trailing edge is pointed at its end; said intrados is provided at its rear portion with a flat surface portion connected to said trailing edge; and said extrados has a curved surface portion provided at least at a portion thereof corresponding to said flat surface portion, wherein an angle of intersection between said intrados and said extrados at the trailing edge is an acute angle.

2. A turbine blade for an axial-flow turbine, which turbine blade is obtained by applying the turbine blade airfoil according to claim 1 to at least a portion of the turbine blade in a span direction.

3. A turbine blade airfoil for an axial-flow turbine according to claim 1, further comprising an arcuate surface portion tangent to the curved surface portion, and wherein a rear end of the arcuate surface portion intersects a rear end of the flat surface portion.

4. A turbine blade airfoil for an axial-flow turbine according to claim 3, wherein the radius of curvature of the arcuate surface portion is smaller than that of the curved surface portion.

5. A turbine blade airfoil for an axial-flow turbine, comprising an intrados producing a positive pressure between a leading edge and a trailing edge, and an extrados producing a negative pressure, wherein said trailing edge is at its end; said intrados is provided at its rear portion with a flat surface portion connected to said trailing edge; and said extrados has a curved surface portion provided at least at a portion thereof corresponding to said flat surface portion wherein an angle of intersection between said intrados and said extrados at the trailing edge is a right angle.

* * * * *